US009574414B2

(12) United States Patent
Arabsky et al.

(10) Patent No.: US 9,574,414 B2
(45) Date of Patent: Feb. 21, 2017

(54) WELLBORE TOOL WITH INDEXING MECHANISM AND METHOD

(75) Inventors: Serhiy Arabsky, Beaumont (CA); James Fehr, Sherwood Park (CA); Daniel Themig, Calgary (CA)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 223 days.

(21) Appl. No.: 14/112,883

(22) PCT Filed: Jul. 27, 2012

(86) PCT No.: PCT/CA2012/050516

§ 371 (c)(1),
(2), (4) Date: Oct. 18, 2013

(87) PCT Pub. No.: WO2013/016822

PCT Pub. Date: Feb. 7, 2013

(65) Prior Publication Data

US 2014/0138101 A1 May 22, 2014

Related U.S. Application Data

(60) Provisional application No. 61/513,448, filed on Jul. 29, 2011.

(51) Int. Cl.
*E21B 34/14* (2006.01)
*E21B 23/06* (2006.01)
(Continued)

(52) U.S. Cl.
CPC ..... *E21B 23/06* (2013.01); *E21B 23/004* (2013.01); *E21B 33/12* (2013.01); *E21B 34/14* (2013.01)

(58) Field of Classification Search
CPC ..... E21B 34/14; E21B 23/01; E21B 23/004
See application file for complete search history.

(56) References Cited

U.S. PATENT DOCUMENTS 2,155,609 A 4/1939 McClendon et al.
2,947,363 A 8/1960 Sackett et al.
(Continued)

FOREIGN PATENT DOCUMENTS

CA 2668129 A1 12/2009
CN 103982167 8/2014
(Continued)

OTHER PUBLICATIONS

Yuan, Feng et al., Single-Size-Ball Interventionless Multi-Stage Stimulation System Improves Stimulated Reservoir Volume and Eliminates Milling Requirements: Case Studies, Oct. 14, 2014, SPE-171183-MS, pp. 1-13, Society of Jetroleum Engineers.
(Continued)

*Primary Examiner* — Robert E Fuller
*Assistant Examiner* — Steven MacDonald
(74) *Attorney, Agent, or Firm* — Bennett Jones LLP

(57) ABSTRACT

A wellbore tool, a wellbore fluid treatment string and a method with an indexing mechanism including a crown ratchet sleeve. The indexing mechanism can be shifted through one or more inactive positions before finally shifting into an active condition. The indexing mechanism is particularly useful with a plug that lands in a seat to impart an axially directed force on the mechanism before passing through the seat.

19 Claims, 9 Drawing Sheets

(51) Int. Cl.
*E21B 23/00* (2006.01)
*E21B 33/12* (2006.01)

(56) References Cited

U.S. PATENT DOCUMENTS

| | | | | |
|---|---|---|---|---|
| 3,053,322 | A | 9/1962 | Kline | |
| 3,054,415 | A | 9/1962 | Baker et al. | |
| 3,112,796 | A | 12/1963 | Myers | |
| 3,878,889 | A | 4/1975 | Seabourn | |
| 4,176,717 | A | 12/1979 | Hix | |
| 4,520,870 | A | 6/1985 | Pringle | |
| 4,893,678 | A * | 1/1990 | Stokley | E21B 34/14 166/238 |
| 5,901,796 | A | 5/1999 | MacDonald | |
| 6,053,250 | A | 4/2000 | Echols | |
| 6,513,595 | B1 | 2/2003 | Freiheit et al. | |
| 6,634,428 | B2 | 10/2003 | Krauss et al. | |
| 6,907,936 | B2 | 6/2005 | Fehr et al. | |
| 6,948,561 | B2 | 9/2005 | Myron | |
| 7,021,389 | B2 | 4/2006 | Bishop et al. | |
| 7,108,067 | B2 | 9/2006 | Themig et al. | |
| 7,416,029 | B2 | 8/2008 | Telfer et al. | |
| 7,469,744 | B2 | 12/2008 | Ruddock et al. | |
| 7,520,336 | B2 | 4/2009 | Mondelli et al. | |
| 7,861,774 | B2 | 1/2011 | Fehr et al. | |
| 8,261,761 | B2 | 9/2012 | Gerrard et al. | |
| 8,272,445 | B2 | 9/2012 | Fay | |
| 8,356,670 | B2 | 1/2013 | Telfer | |
| 8,479,808 | B2 | 7/2013 | Gouthaman | |
| 8,479,823 | B2 | 7/2013 | Mireles | |
| 8,668,013 | B2 | 3/2014 | O'Connell et al. | |
| 8,783,365 | B2 | 7/2014 | McCoy et al. | |
| 8,863,853 | B1 | 10/2014 | Harris et al. | |
| 8,950,496 | B2 | 2/2015 | Kitzman | |
| 9,004,179 | B2 * | 4/2015 | Chauffe | E21B 34/06 166/250.04 |
| 9,010,447 | B2 | 4/2015 | Themig et al. | |
| 9,121,273 | B2 | 9/2015 | Norrid | |
| 9,187,978 | B2 | 11/2015 | Castro | |
| 9,290,998 | B2 | 3/2016 | Radford | |
| 2003/0127227 | A1 * | 7/2003 | Fehr | E21B 33/124 166/306 |
| 2006/0243455 | A1 | 11/2006 | Telfer et al. | |
| 2007/0107944 | A1 | 5/2007 | Lee | |
| 2007/0272413 | A1 | 11/2007 | Rytlewski et al. | |
| 2008/0000697 | A1 | 1/2008 | Rytlewski | |
| 2009/0056952 | A1 | 3/2009 | Churchill | |
| 2009/0308588 | A1 | 12/2009 | Howell et al. | |
| 2010/0206579 | A1 | 8/2010 | Guven et al. | |
| 2010/0252276 | A1 * | 10/2010 | Clausen | E21B 23/006 166/381 |
| 2010/0294514 | A1 | 11/2010 | Crow et al. | |
| 2011/0011597 | A1 | 1/2011 | Fay | |
| 2011/0036590 | A1 | 2/2011 | Williamson et al. | |
| 2011/0036592 | A1 | 2/2011 | Fay | |
| 2011/0067888 | A1 | 3/2011 | Mireles | |
| 2011/0100643 | A1 | 5/2011 | Themig et al. | |
| 2011/0108284 | A1 | 5/2011 | Flores et al. | |
| 2011/0114324 | A1 | 5/2011 | Hayter et al. | |
| 2011/0114334 | A1 | 5/2011 | Palacios | |
| 2011/0127047 | A1 | 6/2011 | Themig et al. | |
| 2011/0232915 | A1 | 9/2011 | Kellner et al. | |
| 2012/0048556 | A1 | 3/2012 | O'Connell et al. | |
| 2012/0097397 | A1 | 4/2012 | Hofman et al. | |
| 2012/0227973 | A1 | 9/2012 | Hart et al. | |
| 2013/0180721 | A1 | 7/2013 | Getzlaf et al. | |
| 2013/0299199 | A1 | 11/2013 | Naedler et al. | |
| 2014/0008071 | A1 | 1/2014 | Patterson et al. | |
| 2014/0076542 | A1 | 3/2014 | Whitsitt et al. | |
| 2014/0138101 | A1 | 5/2014 | Arabsky et al. | |
| 2014/0166304 | A1 | 6/2014 | Cast | |
| 2014/0246209 | A1 | 9/2014 | Themig et al. | |
| 2014/0291031 | A1 | 10/2014 | Lee | |
| 2014/0299319 | A1 | 10/2014 | Pabon et al. | |
| 2015/0114664 | A1 | 4/2015 | Hulsewe et al. | |

FOREIGN PATENT DOCUMENTS

| | | |
|---|---|---|
| WO | 0190529 | 11/2001 |
| WO | 02068793 | 9/2002 |
| WO | WO 2004/022906 A1 | 3/2004 |
| WO | 2011072367 | 6/2011 |
| WO | 2016019154 | 2/2016 |
| WO | 2016049771 | 4/2016 |

OTHER PUBLICATIONS

Chauffe, Steve et al., Frac Sleeve Designed for Multi-Zone Cemented Laterals, Apr. 27, 2015, SPE-174075-MS, pp. 1-13, Society of Petroleum Engineers.

* cited by examiner

WELLBORE TOOL WITH INDEXING MECHANISM AND METHOD

PRIORITY APPLICATION

This application claims priority to U.S. provisional application Ser. No. 61/513,448, filed Jul. 29, 2011.

FIELD OF THE INVENTION

The invention relates to a wellbore tool with an indexing mechanism and methods using the tool.

BACKGROUND OF THE INVENTION

If a wellbore tool is positioned down hole in advance of its required operation, the tool must be actuated remotely. Indexing mechanisms may be useful where a tool is intended to be actuated through a number of positions.

For example, in some tools, indexing mechanisms are employed to actuate a tool through a number of inactive positions before it reaches an active position. For example, indexing mechanisms may be employed in wellbore tools for wellbore fluid treatment such as staged well treatment. In staged well treatment, a wellbore treatment string is deployed to create a plurality of isolated zones within a well and includes a plurality of openable ports that allow selected access to each such isolated zone. The treatment string is based on a tubing string and carries a plurality of packers that can be set in the hole to create isolated zones therebetween about the annulus of the tubing string. Between at least selected packers, there are openable ports through the tubing string. The ports are selectively openable and include a sleeve thereover with a sealable seat formed in the inner diameter of the sleeve. By launching a ball, the ball can seal against the seat and pressure can be increased behind the ball to drive the sleeve through the tubing string to open the port in one zone. The seat in each sleeve can be formed to accept a ball of a selected diameter but to allow balls of lower diameters to pass.

Unfortunately, due to size limitations with respect to the inner diameter of wellbore tubulars (i.e. due to the inner diameter of the well), such wellbore treatment systems may tend to be limited in the number of zones that may be accessed. For example, if the well diameter dictates that the largest sleeve in a well can at most accept a 3¾ ball, then the well treatment string will generally be limited to approximately eleven sleeves and, therefore, can treat in only eleven stages.

SUMMARY OF THE INVENTION

In accordance with an aspect of the present invention, there is provided a wellbore tool comprising: a tubular housing including an upper end, a lower end, and a wall defining an inner bore and an outer surface; a tool mechanism capable of being moved through a plurality of positions; an indexing mechanism for moving the tool mechanism through the plurality of positions, the indexing mechanism including an axis, a first ratchet sleeve including a first plurality of teeth extending substantially parallel to the axis and a notch between each adjacent pair of teeth of the first plurality of teeth, a dog sleeve including an end and a dog extending axially from the end, the dog configured for meshing with the first plurality of teeth of the ratchet sleeve, the dog sleeve and/or the ratchet sleeve being axially and rotationally moveable to permit the dog and the first plurality of teeth to move into and out of engagement and to permit the dog to move from notch to notch along the first ratchet sleeve, the movement from notch to notch corresponding to movement of the tool mechanism through the plurality of positions; a biasing member for urging the dog and the first plurality of teeth into one of (i) meshing engagement or (ii) out of meshing engagement, the biasing member able to be overcome to allow movement of the dog and the first plurality of teeth axially into the other of (i) meshing engagement or (ii) out of meshing engagement; and an actuating mechanism for generating an application of force to overcome the biasing member.

In accordance with another aspect of the present invention, there is provided a wellbore fluid treatment string for installation in a wellbore, the wellbore fluid treatment string comprising: a sliding sleeve sub including: a tubular housing including an upper end, a lower end and a wall defining an inner bore and an outer surface; a fluid port through the wall of the tubular housing; and a sleeve installed in the inner bore, the sleeve being axially slidable in the inner bore at least from a first position covering the fluid port to a second position exposing the fluid port to the inner bore; a first ratchet sleeve including a first plurality of teeth extending substantially parallel to the axis and a notch between each adjacent pair of teeth of the first plurality of teeth and a final notch after the plurality of teeth; a dog sleeve including a dog extending axially from an end thereof for meshing with the first plurality of teeth, the dog sleeve and/or the ratchet sleeve being axially and rotationally moveable to permit the dog and the first plurality of teeth to move into and out of engagement and to permit the dog to move from notch to notch along the first ratchet sleeve until the dog lands in the final notch; a biasing member for urging the dog and the first plurality of teeth into one of (i) meshing engagement or (ii) out of meshing engagement, the biasing member able to be overcome to allow movement of the dog and the first plurality of teeth axially into the other of (i) meshing engagement or (ii) out of meshing engagement; an actuating mechanism for generating an application of force to act against the biasing member; and wherein the sleeve is moveable from the first position to the second position only after the dog lands in the final notch.

In accordance with another aspect of the present invention, there is provided a method for actuating a downhole tool to an active condition, the method comprising: axially moving a component of an indexing mechanism to move a dog in the downhole tool into and out of meshing engagement with a crown ratchet sleeve, the dog being moved from a first notch to a next notch in the indexing mechanism until the dog reaches a final notch in the indexing mechanism, the tool being configured into an active condition when the dog reaches the final notch.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein:

FIGS. 1 to 5 are views of a wellbore tool with an indexing mechanism, wherein:

FIG. 1 is a sectional view through a wellbore tool in a run in position;

FIG. 2 is a view of the tool of FIG. 1 in a position just beginning movement through an indexing cycle;

FIG. 3A is a sectional view taken along the tool's long axis; FIG. 3B is a side elevation of the tool with the housing cut away to show the indexing mechanism; and FIG. 3C is an enlarged sectional view taken along the tool's long axis; FIG. 3A shows a section along the tool between seat segments, which is a sectional view offset from the section shown in FIGS. 1 and 2, while the sectional orientation of FIG. 3C is similar to that shown in FIGS. 1 and 2 (passing through seat segments); FIG. 3C shows an actuator in the bore which has just passed through the seat, while the actuator is omitted in FIG. 3A for clarity;

In FIGS. 4, the tool is shown in the active position; FIG. 4A is a sectional view taken along the tool's long axis and between seat segments; and FIG. 4B is a side elevation of the tool with the housing cut away to show the indexing mechanism; FIG. 4C is an enlarged sectional view taken along the tool's long axis; FIG. 4C shows an actuator in the seat, while the actuator is omitted in FIG. 4A for clarity;

FIG. 5 is a view following after FIGS. 4, in a final position;

DETAILED DESCRIPTION OF VARIOUS EMBODIMENTS

Figure 1:
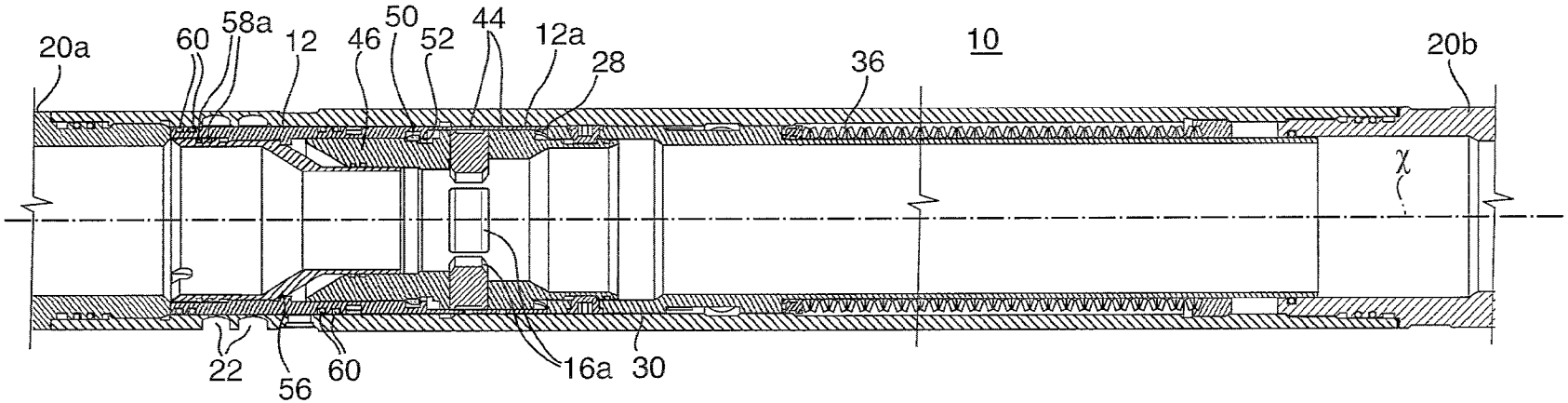

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features, A wellbore tool that is actuable through a plurality of positions may include a tubular housing including an upper end, a lower end, an inner bore and an outer surface; a tool mechanism capable of being moved through a plurality of positions; an indexing mechanism for moving the tool mechanism through the plurality of positions, the indexing mechanism including an axis, a first ratchet sleeve including a first plurality of teeth extending substantially parallel to the axis and a notch between each adjacent pair of teeth of the first plurality of teeth; a dog sleeve including a dog extending axially from an end thereof for meshing with the first plurality of teeth of the ratchet sleeve, the dog sleeve and/or the ratchet sleeve being axially and rotationally moveable to permit the dog and the first plurality of teeth to move into engagement and to permit the dog to move from notch to notch along the first ratchet sleeve; and a biasing member for urging the dog and the first plurality of teeth into one axial position, the biasing member able to be overcome to allow movement of the dog and the first plurality of teeth axially into a second position to permit the dog and the first plurality of teeth to alternate into and out of meshing engagement; and an actuating mechanism for generating an application of force to act against the biasing member.

In operation, the tool may be employed in a wellbore operation wherein the tool is positioned in a well with the housing in a selected position, a force may be applied to an indexing mechanism of the tool to drive a tool mechanism through a plurality of positions, the applied force driving a dog and a plurality of ratchet teeth axially out of engagement and causing a slight relative rotation between the dog and the plurality of ratchet teeth and biasing the dog and the plurality of teeth back into engagement to move the dog from a first position relative to the plurality of teeth to a second position which is slightly rotated from the first position.

Generally, a wellbore tool often has a tubular housing, as a tubular form can pass readily through the wellbore as drilled. Also, tubular forms can be connected by threading into assembled tools or strings deployable into a well. The tool may be run into a well for temporary use or may be installed in a well for longer term use or reuse.

The wellbore tool may be a packer, an anchor, a sliding sleeve tool, etc. The form of the wellbore tool is determined by its tool mechanism. For example, a packer includes a tool mechanism including packing mechanism with at least a set and an unset position, the packing mechanism may include an annular packing element, a compression ring, etc. The tool mechanism of an anchor includes an anchoring mechanism including at least a set and an unset position, the anchoring mechanism may include a plurality of slips, a slip expander, etc. A tool mechanism of a sliding sleeve tool includes a port and a sliding sleeve moveable to open and close the port and the sliding sleeve tool has at least a closed port position and an open port position. As another example, another sliding sleeve tool has a tool mechanism including a port, a sliding sleeve moveable to open and close the port and a seat for the sliding sleeve to allow ball actuation of the sliding sleeve and in such an embodiment, the sliding sleeve valve may include at least an activated seat position ready to catch a ball (or other plug that is sized to seal in the seat) and an inactive seat position wherein either the seat has not yet formed or the seat is in place but the ball may pass through the seat.

The form of the tool determines the method that is carried out by the tool. For example, the method may include forming an annular seal, anchoring a tool, opening a port or forming a seat.

The tools and methods of the present invention can be used in various borehole conditions including open holes, cased holes, vertical holes, horizontal holes, straight holes or deviated holes.

With reference to FIGS. 1 to 5, an example of a wellbore sliding sleeve tool 10 is shown that is modified by the passage therethrough of an actuator 40 that configures a sleeve 12 of the tool to be drivable to an open position by a sleeve shifting device 14, while sleeve 12 was not previously configured for such operation, such that during the subsequent passage of a sleeve shifting device, sleeve 12 may be actuated by the sleeve shifting device. The reconfiguration of the sleeve to be driven by a sleeve shifting device in this embodiment, includes the formation of a seat 16 in non-collapsible form after one or more actuations of the tool, as controlled by an indexing mechanism. For example, in one embodiment, the indexing mechanism may allow the tool to be advanced through a plurality of positions prior to placement in a position wherein the valve seat is actually configured in a non-collapsible way. As shown in the Figures, an actuating mechanism which may include one or more actuators, such as a plurality of balls or other plugs, may cycle the components of the indexing mechanism to advance one position at a time through one or more inactive (also termed passive) positions before finally moving into an active position to form the final, non-collapsible valve seat.

Figure 2:
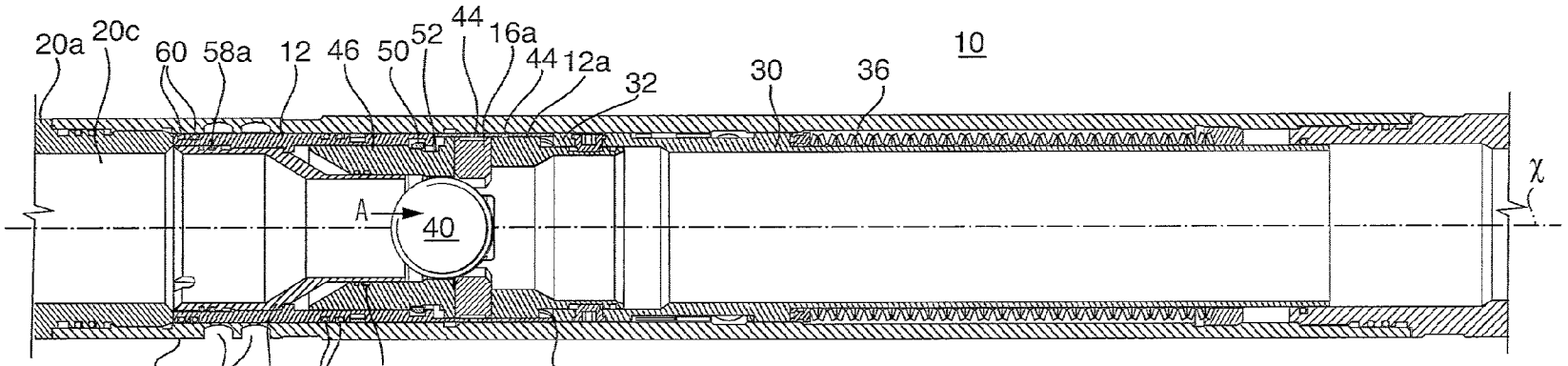
Figure 3A:
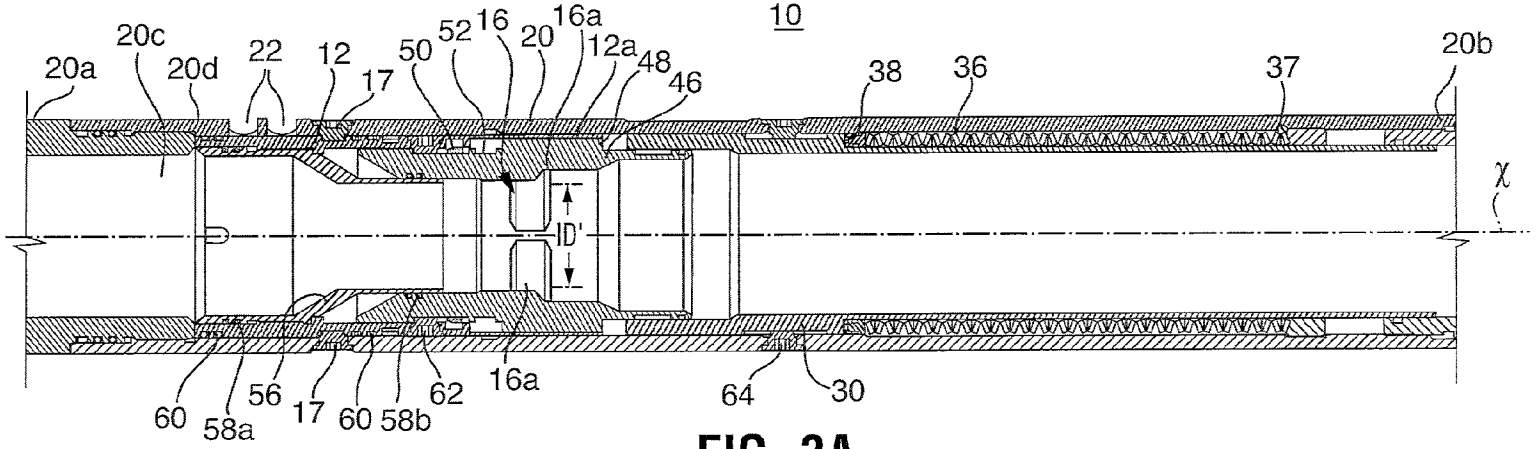
FIGS. 3A, 3B and 3C, sometimes referred to collectively as FIGS. 3, are views of the tool following from FIG. 2 in a later portion of an indexing cycle.
Figure 3B:
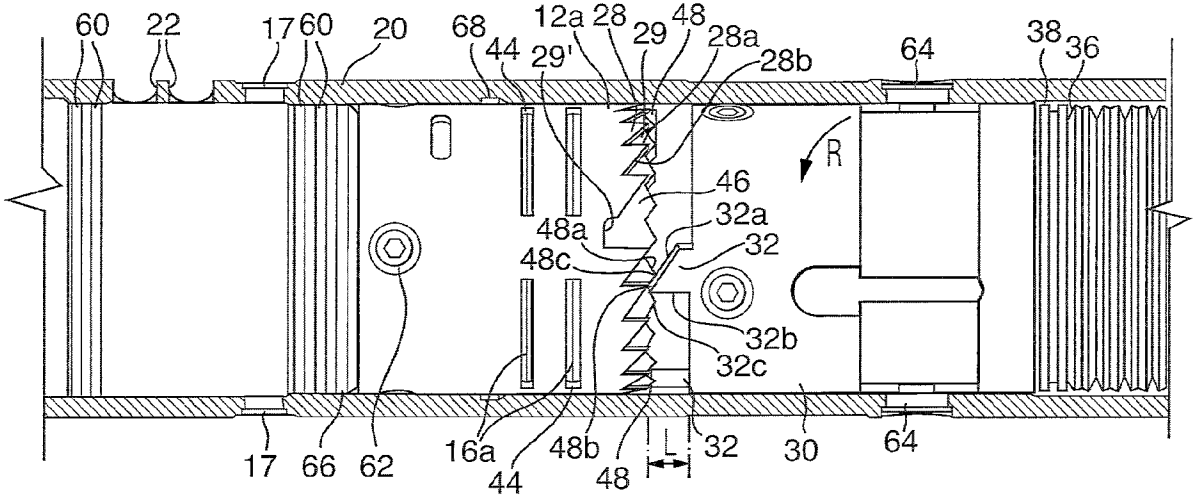
Figure 3C:
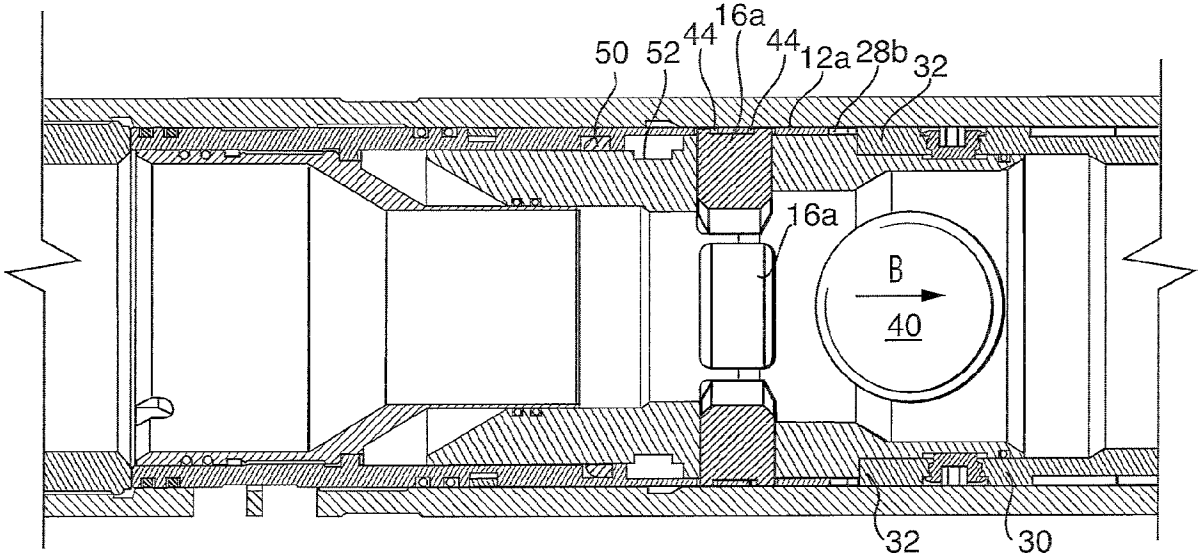
Figure 4A:
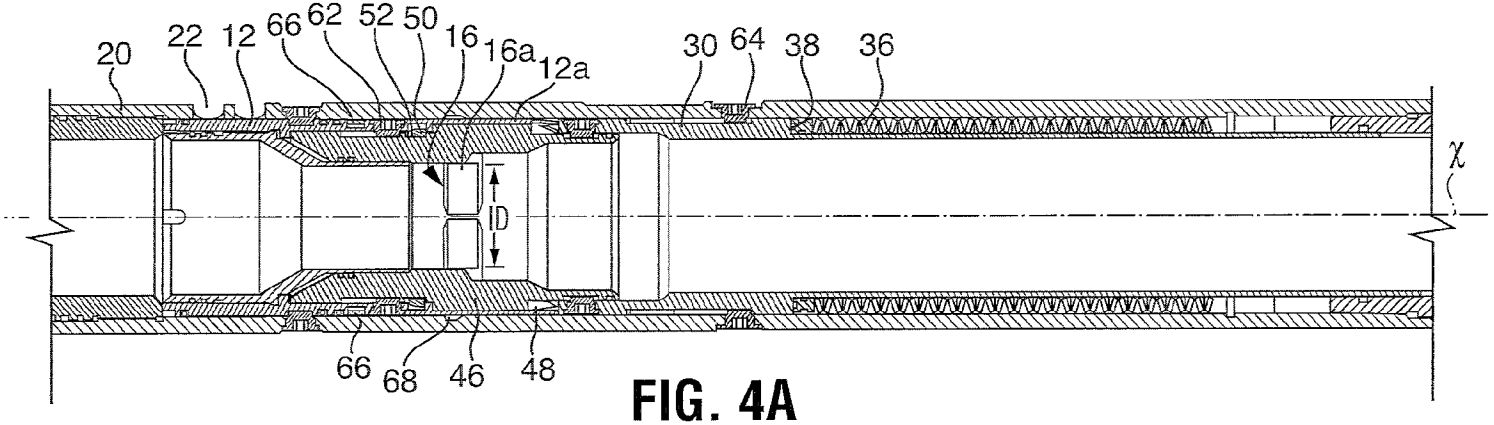
FIGS. 4A, 4B and 4C, sometimes referred to as FIGS. 4, are views of the tool following from FIGS. 3.
Figure 4B:
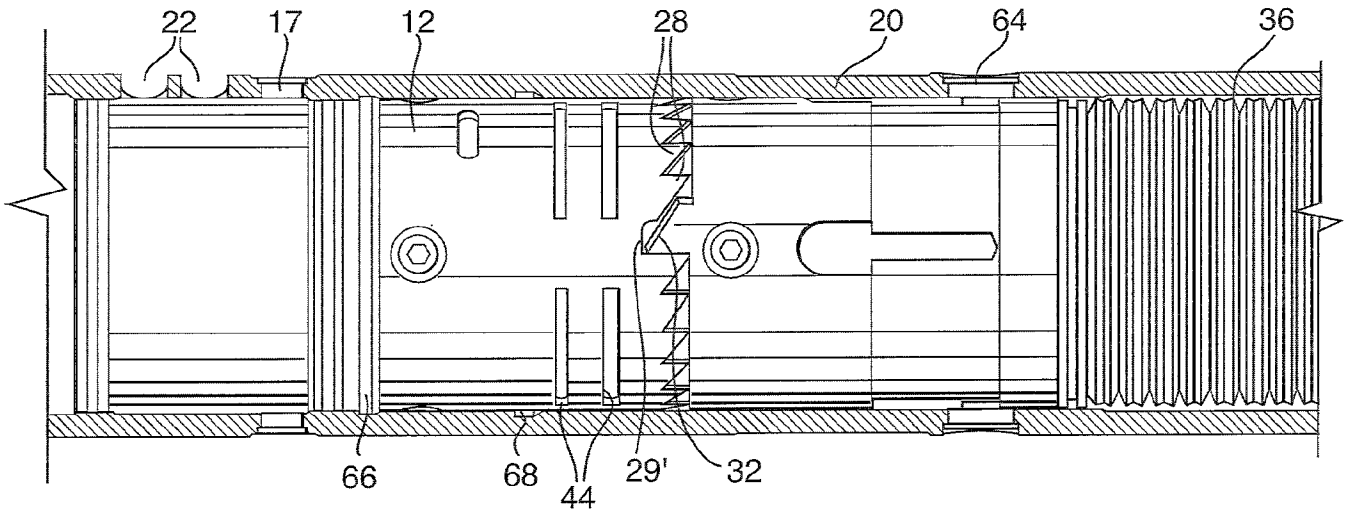
Figure 4C:
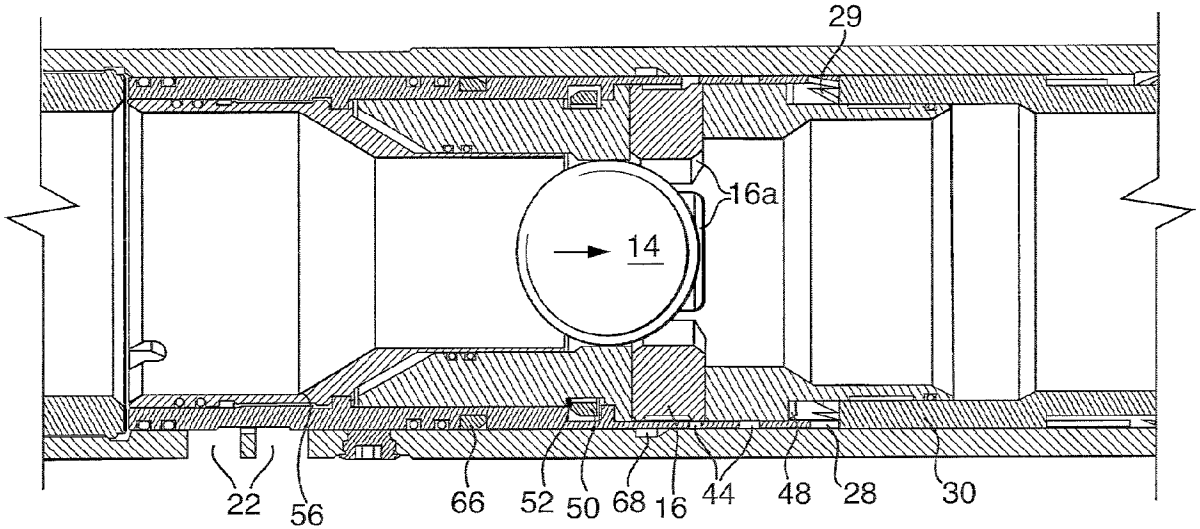
Figure 5:
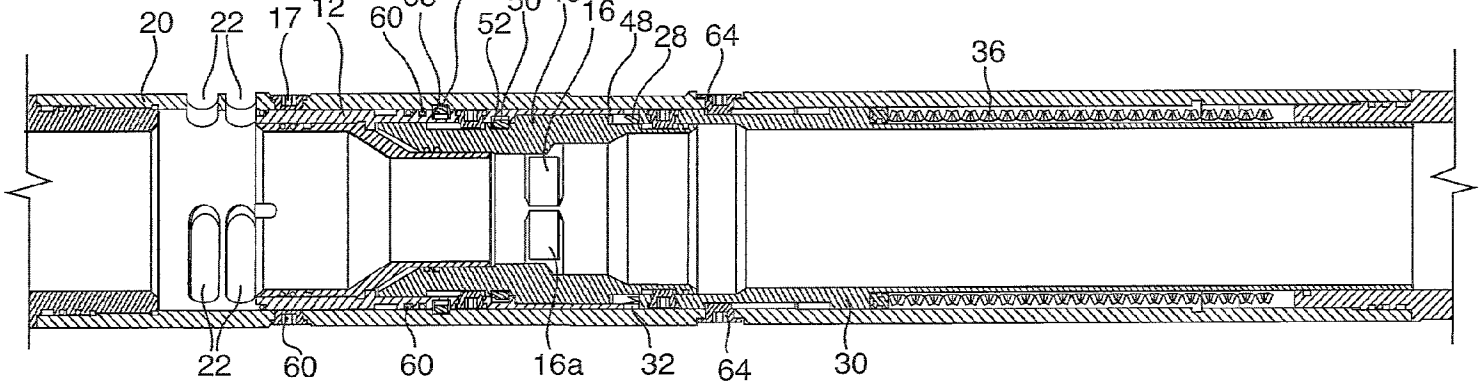

In the drawings, FIG. 1 shows tool 10 in a run in position; FIG. 2 shows an actuator 40 just beginning to move the tool through one indexing cycle; FIGS. 3 show the tool about half-way through an indexing cycle, as driven by actuator 40; FIGS. 4 show tool 10 in an active position, with sleeve 12 reconfigured with seat 16 formed in a non-collapsible way, and sleeve 12 ready to be driven by a sleeve shifting device 14; and FIG. 5 shows tool 10 with sleeve 12 shifted to an open position such that ports 22 are opened for fluid flow therethrough.

The illustrated sliding sleeve tool includes a tubular housing 20 including an upper end 20*a*, a lower end 20*b*, an inner bore 20*c* and an outer surface 20*d*. The sliding sleeve tool, may be formed as a sub with its tubular housing 20 having threaded ends such that it may be connected into a wellbore tubular string. The housing defines a long axis x extending through its ends 20*a*, 20*b*.

The sliding sleeve tool includes one or more ports 22 through the wall of the tubular housing where the port, when opened, provides access between inner bore 20*c* and outer surface 20*d*. The open and closed condition of port 22 is determined by sleeve 12. The sleeve is axially moveable in the tubular housing between a position overlying and closing port 22 (FIG. 1) and a position retracted from, and therefore opening, port 22 (FIG. 5).

The sleeve includes seat 16 that is capable of being configured through a plurality of positions including a plurality of inactive positions and an active position. In the inactive positions (FIGS. 1 to 3) seat 16 is collapsible and allows any actuator, such as ball 40 or other plug form, that lands therein to pass. In the active position, (FIGS. 4 and 5) seat 16 is configured in a non-collapsible way and is capable of catching and retaining sleeve shifting device 14, such as a ball or other plug form. Sleeve shifting device 14 and actuators 40 may be balls, as shown, or other forms of plugs, that are launchable from surface and sized to have an OD greater than the uncollapsed ID of seat 16. The ball 40 may actually be identical to ball 14, but the seat collapses when it is in an inactive configuration to let ball 40 pass, while seat 16, when active, is configured to retain and create a seal with ball 14, which explains the differing operations. In the active position as shown in FIG. 4, seat 16 cannot collapse and sleeve shifting device 14 that is sized to be larger than the uncollapsed ID of the seat will be caught in the seat and cannot pass through. Sleeve shifting device 14, therefore, lands in and creates a substantial seal with the seat. Thus, an axially directed force can be applied to sleeve 12 by fluid pressure through the piston effect created by device 14 in seat 16. The applied pressure can overcome any holding devices such as shear pins 17 and drives the sleeve to open (FIG. 5).

The indexing mechanism is operable to control the movement of the tool mechanism through the plurality of positions. In the illustrated embodiment, the indexing mechanism is substantially coaxial with axis x. The indexing mechanism includes an end of sleeve 12 formed to act as a first ratchet sleeve 12*a* and includes a first plurality of teeth 28 extending substantially parallel to the axis and a notch 29 between each adjacent pair of teeth of the first plurality of teeth and a notch 29' after the last tooth of the first plurality of teeth. The first plurality of teeth 28 are positioned at the end of the sleeve and the teeth extend axially from the end of sleeve 12 with the notches 29 exposed. At least a portion of the base of each tooth 28, where the tooth extends from sleeve 12, is axially in line with both the flanks 28*a*, 28*b* of the tooth and the sleeve, such that any force substantially parallel to axis x that is applied against the flanks can pass axially through the tooth, through its base and into sleeve. The teeth and the notches alternate in a direction about the circumference of the sleeve such that the end of the sleeve 12 has a saw tooth effect. As such, the first ratchet sleeve may be termed a crown-type ratchet sleeve.

Each tooth of the plurality of teeth include a steeply sloped front flank 28*a* and a moderately sloped rear flank 28*b*, causing the notches 29 to each be generally V-shaped.

The first ratchet sleeve may include any number of teeth to form any number of notches 29, 29'. The number of notches may be selected to be at least equal to the number of positions through which the indexing mechanism is intended to move in operation. For example, notches 29, 29' may be formed about the entire circumference of the end of the sleeve and, as such, depending on the size of each notch and the diameter of the sleeve, there may be a great number of notches. On the other hand if it is desired to index the tool through only a few positions, then only a few notches need be formed. In one embodiment, for example, the indexing mechanism is formed with a number of notches, for example fifteen, selected to be the maximum number of possible indexing positions the tool is to have, which allows the tool to be set up to have any number of indexing positions up to fifteen.

All teeth/notches may be similarly formed or there may be differing forms depending on the intended operation of the indexing mechanism. As will be better appreciated from the following description, the presently illustrated indexing mechanism is intended to impart a final axial shift in the tool, when the indexing mechanism reaches its final position, thus the notches may have differing depths, and in this embodiment, for example, the final notch 29' is positioned at the end of the plurality of teeth and has a depth that it penetrates axially into the end of the greater than the depth of other notches 29.

The indexing mechanism further includes a dog sleeve 30 including a dog 32 extending axially from an end thereof. In the illustrated embodiment, dog 32 is positioned at the end of dog sleeve 30 and extends fully beyond the end of ratchet sleeve 12*a* such that its side edges 32*a*, 32*b* are fully, axially exposed. At least a portion of the base of dog 32, where the dog extends from sleeve 30, is axially in line with side edges 32*a*, 32*b* of the tooth and with the sleeve, such that any force parallel to axis x against the flanks can pass axially through the dog, through its base and into sleeve 30. In the tool, dog sleeve 30 is installed such that dog 32 extends toward teeth 28 of sleeve 12*a*. Dog 32 is sized and shaped to mesh with the first plurality of teeth of the ratchet sleeve 12*a*. For example, dog 32 is sized and shaped to fit into the notches 29, 29' formed by the teeth. One, as shown, or both side edges 32*a*, 32*b* are sloped toward the outboard tip 32*c* of the dog such that the outboard end of the dog is wedge shaped. In the illustrated embodiment, dog 32 has a length L extending beyond the end of the sleeve sufficient to protrude into and substantially bottom out in all notches, including final notch 29' that has the greater depth.

Dog sleeve 30 and ratchet sleeve 12*a* are installed in a substantially coaxial manner within housing, are positioned axially offset from each other along axis x and are sized to be able to butt against each other at teeth 28 and dog 32. For example, the inner/outer diameters at teeth 28 and at dog 32 are selected such that the sleeves cannot telescope into one another at the location of the teeth and, instead, when the sleeves 12*a* and 30 are axially moved toward each other, the dog and teeth 28 and dog 32 are positioned to butt against, and mesh with, each other. For example, dog sleeve 30 at dog 32 has an outer diameter greater than the inner diameter of sleeve 12*a* at teeth 28.

Either or both of these sleeves 12*a,* 30 are axially and rotationally moveable to permit dog 32 and the first plurality of teeth 28 to move into and out of engagement and to permit the dog 32 to move from notch to notch along the first ratchet sleeve. In the illustrated embodiment, first ratchet sleeve 12*a* is rotationally and axially fixed within housing during indexing, while dog sleeve 30 is moveable both axially toward and away from sleeve 12*a* and rotationally about axis x, as shown by arrow R in FIG. 3B.

The indexing mechanism further includes a biasing member, such as spring 36, for biasing the parts of the indexing mechanism into one axial position. For example, the biasing member may urge the dog and the first plurality of teeth into one of (i) meshing engagement or (ii) out of meshing engagement. The biasing member is, however, able to be overcome to allow movement of the dog and the first plurality of teeth axially into the other of (i) meshing engagement or (ii) out of meshing engagement. In the illustrated embodiment, spring 36 urges the dog and the first plurality of teeth into meshing engagement, but spring 36 is able to be overcome by application of force against the spring force of spring 36, to allow movement of the dog and the first plurality of teeth axially away from each other and out of engagement. Thus, in the illustrated embodiment, spring 36 is positioned between a shoulder 37 on the housing and a shoulder 38 on dog sleeve 30 and spring 36 acts between these shoulders 37, 38 to bias dog sleeve 30 toward first ratchet sleeve 12*a* to normally ensure the meshing of dog 32 into a notch 29, 29', but dog 32 can be removed from the notch in which it is positioned by applying a force to compress spring 36 and move sleeve 30 and dog 32 away from sleeve 12*a*. In the illustrated embodiment, the force may be applied to spring 36 through dog sleeve 30.

As noted above, an actuating mechanism may be employed for generating an application of force to act against spring 36. For example, the present tool is intended for use downhole and there are a few ways to apply a force against the spring when it is downhole. For example, an axial force may be applied by a string conveyed tool, such as on a wireline, a tubing string, etc. Alternately, an axial force may be applied hydraulically. For example, a piston that is in place or a piston that is established by landing a plug in a seat, may be employed for hydraulic actuation. The form of the actuating mechanism may be selected depending on the way in which the force is to be applied. For example, if driven by a string conveyed tool, the actuating mechanism may include the tool and a gland into which the tool lands and engages. In the illustrated embodiment, the axial force is applied hydraulically and the actuating mechanism includes an actuator, such as ball 40 as noted above, that lands on a ball seat in the tool, which in this embodiment, is the same seat 16 that will eventually move sleeve 12. The actuator may be free of any connection to surface such that it may be rapidly and simply conveyed to actuate the tool by being introduced at surface and conveyed by gravity or fluid flow to the seat. Once ball 40 lands on seat 16, an axial force is generated. The axial force may be from impact or through a hydraulic force. For example, seat 16 may simply act as a ball stop that receives impact force from the ball before the ball passes, or seat 16 may act as a ball stop that holds the ball in a sealing position relative to an uphole portion of the structure on which the seat is carried or alternately seat 16 may itself be formed to create a substantial seal with the ball across the inner diameter of seat and a pressure differential can be created across the seal, wherein the pressure uphole of the ball/seat is greater than the pressure downhole of the ball/seat and a force is applied toward the lower pressure side.

The force generated through the actuating mechanism, herein ball 40 and seat 16, drives dog 32 to move from notch to notch. For example, in this embodiment, the force, arrow A in FIG. 2, generated by ball 40 landing in seat 16 moves dog 32 out of one notch 29 so the dog can move to another notch and, thereby, advance through the indexing mechanism. For example, the force applied by ball 40 in seat 16 acts against spring 36, to remove dog 32 axially from the notch 29 in which it is held by spring 36. Thereafter, the indexing mechanism is selected to cause the dog sleeve to rotate, or be rotated along arrow R, to place dog 32 into alignment with a next notch 29 during or after the application of force and, once the applied force is discontinued, spring 36 drives dog 32 back toward first ratchet sleeve 12*a* and into the next notch. This operation is shown in FIGS. 2 and 3.

The actuating mechanism, therefore, may operate to only temporarily apply force such that the dog sleeve can be released to move into the next notch. In the case of a string conveyed tool, the string may be slacked off or picked up to discontinue the application of force or the tool may be disengaged from the indexing mechanism. In the case of a fluid pressure-based actuating mechanism, as illustrated, the fluid pressure, for example, the pressure differential may be dissipated. The fluid pressure may be dissipated from surface or any piston effect may be removed. In the presently illustrated embodiment, after an appropriate force is applied through seat 16, ball 40 is able to pass through seat 16 to remove the piston effect. For example, the ball may be selected to be deformable to pass through the seat or, as shown, seat 16 may be selected to be deformable to allow the ball to pass, after an appropriate force has been applied. Seat 16 is only temporarily deformable and rapidly resets to be ready to catch and seal with another ball such that the dog 32 can be moved to a further notch. In particular, in this illustrated embodiment, seat 16 includes a plurality of segments 16*a* that together form an annular seat structure. The seat segments normally protrude inwardly defining a normal seat ID to catch a suitably sized ball. However, seat segments 16*a* can be expanded outwardly to enlarge the seat to ID' so that ball can pass through. In this embodiment, segments 16*a* can be moved axially along the tubular housing to align over openings 44 into which the seat segments can expand outwardly. When the seat segments expand outwardly into openings 44, the inner diameter of the seat is enlarged to ID' and the ball can pass and continue down, as shown by arrow B in FIG. 3C.

As noted above, the indexing mechanism in this embodiment is selected to cause the dog sleeve to rotate or be rotated into alignment with a next notch 29 during or after the application of force. In the illustrated embodiment, the rotation is caused in part by the form of teeth 28, the form of dog 32 and the interaction thereof. Teeth 28 and dog 32 mesh axially, for example dog 32 can mesh with teeth 28 by axial movement toward sleeve 12*a*, but dog 32 can be removed from meshing engagement with teeth 28 by axial movement away from sleeve 12*a*. As noted above, teeth 28 and dog 32 include sloped surfaces defined by flanks 28*b* and side edge 32*a*, respectively, which when making contact, urge rotation of the dog sleeve relative to the first ratchet sleeve. In particular, when the dog's sloped side edge 32*a* is driven against rear flank 28*b* of a tooth, as by the force of spring 36, dog 32 is urged to slide along the slope of flank 28*b* until the dog bottoms out in notch 29. This sliding action causes the dog sleeve to rotate relative to first ratchet sleeve 12*a*.

In the illustrated embodiment, further components of the actuating mechanism also urge rotation of the dog sleeve. For example, the actuating mechanism includes an actuating sleeve 46 on which seat 16 is carried. Actuating sleeve 46 is positioned concentrically within first ratchet sleeve 12*a* and is axially moveable therein between a recessed position relative to teeth 28 and the notches (FIGS. 1 and 2) and an extended position (FIGS. 3) wherein an end 46*a* of sleeve 46 extends axially beyond teeth 28. At least in the extended position, end 46*a* of actuating sleeve 46 is positioned to bear against dog 32. In particular, first ratchet sleeve 12*a* and actuating sleeve 46 are both positioned and sized to contact dog 32. For example, as noted above, dog sleeve 30 at dog 32 has an outer diameter greater than the inner diameter of sleeve 12*a* at teeth 28 and dog sleeve 30 at dog 32 has an inner diameter less than the outer diameter of sleeve 46 at end 46*a*. Thus, actuating sleeve 46 can be driven by application of hydraulic force through seat 16 into the extended position and, in so doing, to move axially out and push dog 32 axially away from sleeve 12*a* and out of engagement with the notch 29 in which it was positioned. The bias in spring 36 ensures that dog 32 is biased against sleeve 12*a* or sleeve 46, depending on whichever sleeve is protruding axially out beyond the other. When the force through seat 16 is discontinued, as when segments 16*a* expand out into openings 44 and ball 40 passes, sleeve 46 no longer has a force pushing it down and the bias in spring 36 pushes dog 32 against sleeve 46 to push sleeve 46 back into a recessed position into sleeve 12*a* until dog 32 comes back to rest against teeth 28 of the first ratchet sleeve.

Actuating sleeve 46 also includes a plurality of teeth on end 46*a*, for clarity referenced herein as the second plurality of teeth 48. Teeth 48 extend substantially parallel to the axis x. Each tooth of the plurality of teeth 48 includes a sloped front flank 48*a* and a sloped rear flank 48*b* that merge to form a point 48*c*. Flanks 48*a*, 48*b* extend in a direction along the circumference of the sleeve such that the end of the sleeve 46 has a saw tooth effect. In the illustrated embodiment, while the teeth are not at an end of the sleeve, the second plurality of teeth 48 extend from the sleeve with the flanks 48*a*, 48*b* axially exposed. As such, the actuating sleeve may also be termed a crown-type ratchet sleeve.

The number of teeth on actuating sleeve 46 is at least equal to the number of notches 29 on ratchet sleeve 12*a*. Teeth 48 are sized and positioned to correspond with the size and position of the teeth on sleeve 12*a*. In particular, teeth 48 are sized and positioned such that points 48*c* line up with notches 29 and, in particular, each point 48*c* lines up along a rear flank 28*b* of a tooth, between the tip 28*c* of a tooth and the bottom of the adjacent notch 29.

In the illustrated embodiment, the rotation of sleeve 30 is also caused in part by the interaction of teeth 48 against dog 32. Teeth 48 and dog 32 can mesh axially. As noted above, teeth 48 and dog 32 include sloped surfaces 48*b* and 32*a*, respectively, which when making contact, urge rotation of the dog sleeve relative to the actuation sleeve and the first ratchet sleeve. In particular, when sleeve 46 is driven axially by hydraulic pressure, the sloping surface of flank 48*b* drives against the dog's sloped side edge 32*a* (as is clearly shown in FIG. 3B) and dog 32 tends to slide along the slope in flank 48*b* until the dog bottoms out in the space between flanks 48*a*, 48*b*. Thus, sleeve 30 is driven to rotate a small increment and when the force through seat 16 is discontinued, as when segments 16*a* expand out into openings 44, the bias in spring 36 pushes sleeve 30 against sleeve 46 until it is recessed back into sleeve 12*a* and dog 32 can come back to bear against the flanks of a tooth 28 of the first ratchet sleeve. By the continued force of spring 36, dog 32 is then urged to slide along the slope of flank 28*b* until it bottoms out in notch 29. This completes the incremental rotation of dog sleeve 30 and has moved dog 32 from one notch to a next notch. Also, sleeve 46 is fully pushed back to a recessed position within sleeve 12 at least to the depth of the notch in which the dog is positioned.

In this illustrated embodiment, actuator sleeve 46 also acts with indexing mechanism to configure the seat 16 into an active position ready for use in the opening of ports 22.

Sleeve 12, for example, carries a lock ring 50 that is initially out of alignment with a gland 52 on sleeve 46. When the lock ring and the gland are out of alignment, the sleeves 12 and 46 can slide axially relative to each other. The lock ring and the gland remain out of alignment as long as the dog rides in notches 29, but when dog 32 enters deeper notch 29', sleeve 46 is driven by dog 32 and the force of spring 36 axially further recessed back into sleeve 12, lock ring 50 aligns with gland 52 and snaps therein to lock the sleeves 12 and 46 together (FIG. 4). This also locks segments 16*a* out of alignment with openings 44. Since sleeve 46 can no longer slide to align segments 16*a* with openings 44, segments 16*a* are supported on their backside against radial outward expansion, the seat can no longer collapse. Thus, any subsequent ball that is introduced that is larger than the ID can seat in seat 16 and will not be capable of passing therethough. Pressure differentials much greater than those used to cycle the indexing mechanism can then be generated to shear out pins 17 and move sleeve 12 and sleeve 46 together to open ports 22 (FIG. 5). In FIG. 5, the ball has moved out of seat 15 and migrated up hole.

Sleeve 46 can be protected from inadvertent axial movement by provision of a pressure shield 56. Pressure shield is sealed by seals 58*a* against sleeve 12 and by seals 58*b* against an inner diameter of sleeve 46 to shield the upper end thereof from problematic pressure regimes, as may be generated for example by pressure drops generated by fluid passing through sleeve 46. Shield 56 is secured to sleeve 12 and sleeve 46 is axially moveable relative to the shield without restriction until sleeve 46 is locked to sleeve 12.

As will be appreciated, the downhole tool can include various components for appropriate operations. For example, seals 60 may be positioned between sleeve 12 and housing 20 to prevent fluid leakage and bypass. Torque pins, such as pins 62, 64 may be employed in slots to control against rotation of the parts. Pin 62 prevents relative rotation of sleeves 12*a* and 46 and pin 64 prevents rotation of sleeve 30 within housing 20 after ports 22 are opened. Also, if desired for balance and to prevent difficulties such as jamming, there may be more than one indexing set up, for example, a plurality of teethed regions including a plurality of notches 29 ending in notch 29' and a dog for each plurality of teethed regions. For example, two dogs 32 can be seen in FIG. 3B and the teeth above notch 29' are a separate ratchet rack than the teeth below notch 29'. For example, the teethed regions forming independent ratchet racks may be substantially evenly spaced apart about the circumference of the sleeve 12. Also, a lock ring 66 and gland 68 may be provided for locking sleeve 12 in a port open position, as shown in FIG. 5.

Likewise, a mode of construction may be employed that best configures the parts and/or facilitates construction. For example, it is noted that many parts are formed of interconnected subcomponents.

The tool illustrated in FIGS. 1 to 5 may be employed in a method to index a tool through a plurality of inactive positions before arriving at an active position. For example, the indexing mechanism can be set to undergo any number of cycles, in other words any number of incremental rotations, up to the maximum number of notches 29 before arriving at deep notch 29'. The number of cycles may be selected based on the number of balls that are intended to pass through the tool prior to the tool being configured for its main function.

When cycling though inactive positions, as the ball 40 reaches seat 16, the ball hits the segments 16*a*. The force of the ball hitting the segments causes actuating sleeve 46 to move axially down until it extends axially beyond sleeve 12*a* and pushes on dog sleeve 30. This action pushes dog 32 out of the notch in which it was positioned. After sleeve 46 and the seat segments 16*a* it carries move far enough down that segments 16*a* expand out into openings 44, two things happen: dog sleeve 30 is rotated though a portion, for example half, of its intended rotation (by teeth 48 lifting dog 32 out of its notch 29 and flank 48*b* driving against side 32*a* of dog 32) and ball 40 can pass through segments 16*a* and proceed down hole. This is the position shown in FIGS. 3. After the ball has passed through seat 16, the force on sleeve 46 is removed and dog sleeve 30 is pushed back uphole by the bias in spring 36. Sleeve 30 completes its intended rotation because of interaction of side 32*a* against tooth flank 28*b* on first ratchet sleeve 26. This motion will also push actuating sleeve 46 back up to move segments 16*a* out of openings 44 causing them to reform the contracted collapsible seat. The tool is thereby reset in another inactive position ready for another ball similar to ball 40 to arrive to repeat the motion.

When the tool is reset into the penultimate notch (i.e. the notch before the final deep notch 29'), the next ball to land in seat 16 will cause dog sleeve 30 to rotate and move dog 32 into final deep notch 29'. When dog 32 enters notch 29', this pushes actuating sleeve 46 a bit further uphole and gland 52 is aligned with ring 50 and a lock is formed between sleeve 46 and sleeve 12. Segments 16*a* can therefore no longer move into alignment with openings 44 and are held against collapsing and any ball 14 landing against seat 16 will move sleeve 12 along with sleeve 46 to open ports 22 in housing 20.

The indexing mechanism allows tool to be indexed through a plurality of inactive seat positions before a final active, non-collapsible seat is formed. It is noted that from FIG. 3B that the illustrated tool would have to be actuated at least four more times before reaching the deeper notch 29' where the final active, non-collapsible seat is formed. The final active, non-collapsible seat can be used to drive the sleeve and open ports in the tool to provide fluid access between the tool's inner bore and the tool's outer surface.

The indexing mechanism is durable since the shear forces that are generated during every cycle of the tool are absorbed through the indexing mechanism also in a fully axial direction, parallel to long axis x, through the dog, through its base and into sleeve 30. All meshing portions of the indexing mechanism also operate in the axial direction, which reduces damage and failure. For example, the axial forces generated by spring are absorbed axially through sleeve 12*a* and the axial force to move the tool through the indexing positions, which is that force arising from ball 40 landing in seat 16, passes axially through sleeve 46 and into the dog, through its base and into sleeve 30.

It is to be understood that modifications can be made to the tool and its indexing mechanism. For example, there could be two separate seats in the tool, one intended for collapsing to actuate the tool through the indexing positions and one that is normally held in an inactive position and only becomes active after the tool is indexed into the final active position.

As another option, the tool could be configured to actually open the sleeve when moving to the final position of the indexing mechanism.

Figure 6:
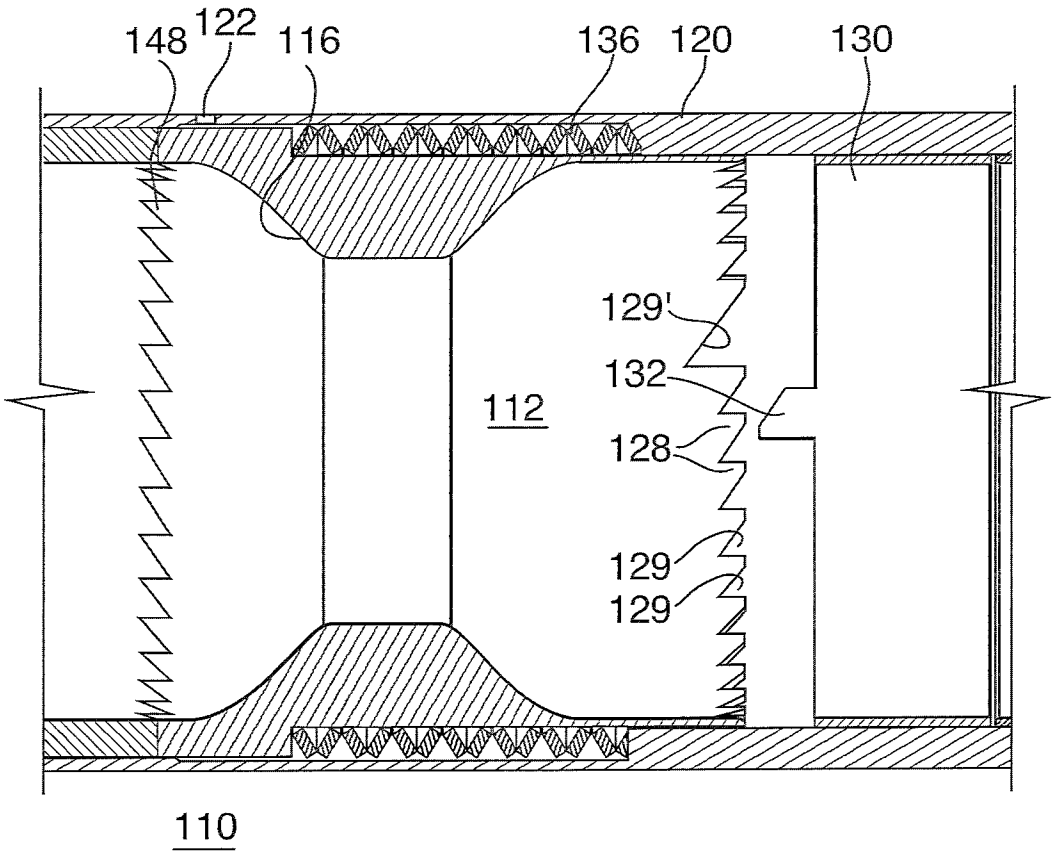
FIG. 6 is a sectional view through another wellbore tool with an indexing mechanism.

As an example, another embodiment of a tool 110 with an indexing mechanism according to the present invention is shown in FIG. 6. In the embodiment of FIG. 6, it is noted that seat 116 operates with deformable plugs. The plug can deform to pass through seat 116 and actuate it from notch to notch. Also, it is noted that first ratchet sleeve 126 carries ratchet form teeth on its opposing ends. Sleeve 126 has both (i) teeth 128 that mesh axially with dog 132 and (ii) teeth 148, that act like teeth 48 of sleeve 46 in the previous embodiment, to convert axial movement to rotational movement and drive a portion of the rotation in the indexing mechanism. Teeth 148 mesh with further ratchet teeth 149 rather than directly with dog 132. Also, the biasing member 136 acts on sleeve 112 to move it axially, along axis x, while dog sleeve 130 remains axially fixed and biasing member 136 urges the teeth of first ratchet sleeve out of engagement with dog 132 but meshing can occur by overcoming the bias in member 136, as by landing a ball temporarily in a seat 116. Also, sleeve 112 is driven rotationally by actions of the teeth 128, 148, while dog sleeve 130 remains torque locked. However, in spite of these and other differences, the tool can be indexed by axial movements of one component relative to another to ratchet the tool through a plurality of inactive positions to arrive at an active position. In particular, the axial movements alternately mesh and disengage a ratcheting sleeve and a dog to move the indexing mechanism through a plurality of positions wherein the tool is inactive, until dog 132 eventually is positioned in a final position, for example, in a deeper notch 129', which corresponds with an active position of the tool. In this embodiment, the active position is a position when sleeve 112 is moved axially far enough, by dog 132 penetrating into deeper notch 129', to open ports 122 through the wall of the tool's housing 120.

The tool of FIG. 6 could be modified, if desired, to have a collapsible seat and work with non-deformable balls, to have two seats one for actuating through the indexing mechanism and one for being configured to move the sleeve to finally open ports 122, to have the concentric indexing arrangement of FIGS. 1 to 5, etc.

The sliding sleeve tools 10, 110 described above may be employed in methods which provide for selective communication to a wellbore for fluid treatment thereof. In one aspect of the invention the sliding sleeve tools and the methods provide for staged injection of treatment fluids wherein ports 22, 122 are opened to permit fluid to be injected into selected intervals of the wellbore, while other intervals are closed. In another aspect, the method may include running in of a fluid treatment string, the fluid treatment string having ports substantially closed against the passage of fluid therethrough, but which are each openable by operation of tools 10, 110 when desired to permit fluid flow into the wellbore.

In embodiments where cycling is of interest, the indexing mechanism may be used to allow the tool to cycle through a number of inactive positions before arriving at an active position, wherein seat 16 is formed non-collapsible (as in FIGS. 4) or ports 122 are opened, as in the embodiment of FIG. 6. Of course, the indexing mechanism, such as that shown in FIGS. 1 to 5 or that shown in FIG. 6, provides a reliable yet simple solution where the tool must pass through a larger number (more than two or three) inactive positions before arriving at the active state. Also, for example in FIGS. 1 to 5, the cycling of the tool through inactive positions does not unseat sleeve 12 from its seals 60, which may be beneficial.

In use, one or more of the tools with an indexing mechanism may be positioned in a tubing string. Because of their usefulness to increase the possible numbers of sleeves in any tubing string, the sliding sleeve tools may often be installed above one or more sleeves having a set valve seat. For example, with reference to FIG. 7, a wellbore tubing string apparatus may include a tubing string 614 having a long axis and an inner bore 618, a first sleeve 632 in the tubing string inner bore, the first sleeve being moveable along the inner bore from a first position to a second position; a second sleeve 633 in the tubing string inner bore, the second sleeve offset from the first sleeve along the long axis of the tubing string, the second sleeve being moveable along the inner bore from a third position to a fourth position; and a third sleeve 634 offset from the second sleeve and moveable along the tubular string from a fifth position to a sixth position. The first sleeve may have an indexing mechanism such as according to one of the embodiments described above, but illustrated according to the embodiment of FIGS. 1 to 5, having an actuating mechanisms 638 therein, which can be actuated to form a non-collapsible valve seat (shown not yet formed). The second and third sleeves may be reconfigurable or, as shown, standard sleeves, with a set valve seat 626*a*, 626*b* therein.

The sleeve furthest downhole, sleeve 634, includes valve seat 626*b* with a diameter D1 and the sleeve thereabove has valve seat 626*a* with a diameter D2. Diameter D1 is smaller than D2 and therefore sleeve 634 requires the smaller ball 623 to seal thereagainst, which can easily pass through the seat of sleeve 633. Actuating mechanism 638 of sleeve 632 includes a collapsible seat with an inner diameter D2.

This provides that the lowest sleeve 634 can be actuated to open first by launching ball 623 which can pass without effect through all of the sleeves 633, 632 thereabove but will land in and seal against seat 626*b*. Second sleeve 633 can likewise be actuated to move along tubing string 612 by ball 636 which is sized to pass through all of the sleeves thereabove to land and seal in seat 626*a*, so that pressure can be built up thereabove. However, in the illustrated embodiment, although ball 636 can pass through the sleeves thereabove, it may actuate those sleeves, for example sleeve 632, to generate valve seats thereon. For example, when ball 636 passes sleeve 632, the ball catches in actuating mechanism 638 and cycles the sleeve from one notch for an inactive position to a next notch for an active position and forms a non-collapsible seat. For example, actuating mechanism 638 on sleeve 632 includes the collapsible seat with a diameter D2 and is formed to be axially moved by ball 636 passing thereby cycle the indexing mechanism and create the non-collapsible seat. However, ball 636 does pass through sleeve 632 and the ball can continue to seat 626*a*.

Of course, where the first sleeve, with the configurable valve seat, is positioned above other sleeves with valve seats formable or fixed thereon, the formation of the valve seat on the first seat should be timed or selected to avoid interference with access to the valve seats therebelow. As such, for example, the inner diameter of any valve seat formed on the first sleeve should be sized to allow passage thereby of actuators (i.e. plugging balls or other plugs) for the valves therebelow. Alternately, and likely more practical, the timing of the actuation of the first sleeve to form a valve seat is delayed until access to all larger diameter valve seats therebelow is no longer necessary, for example all such larger diameter valve seats have been actuated or plugged.

In one embodiment as shown, the wellbore tubing string apparatus may be useful for wellbore fluid treatment and may include ports 617 over or past which sleeves 632, 633, 634 act.

In an embodiment where sleeves 632, 633, 634 are positioned to control the condition of ports 617, note that, as shown, in the closed port position, the sleeves can be positioned over their ports to close the ports against fluid flow therethrough. In another embodiment, the ports for one or both sleeves may have mounted thereon a cap extending into the tubing string inner bore and in the position permitting fluid flow, their sleeve has engaged against and opened the cap. The cap can be opened, for example, by action of the sleeve shearing the cap from its position over the port. Each sleeve may control the condition of one or more ports, grouped together or spaced axially apart along a path of travel for that sleeve along the tubing string. In yet another embodiment, the ports may have mounted thereover a sliding sleeve and in the position permitting fluid flow, the first sleeve has engaged and moved the sliding sleeve away from the first port.

The tubing string apparatus may also include outer annular packers 620 to permit the creation of isolated wellbore segments between adjacent packers. The packers can be of any desired type to seal between the wellbore and the tubing string. In one embodiment, at least one of the first, second and third packer is a solid body packer including multiple packing elements. In such a packer, it is desirable that the multiple packing elements are spaced apart.

Figure 7:
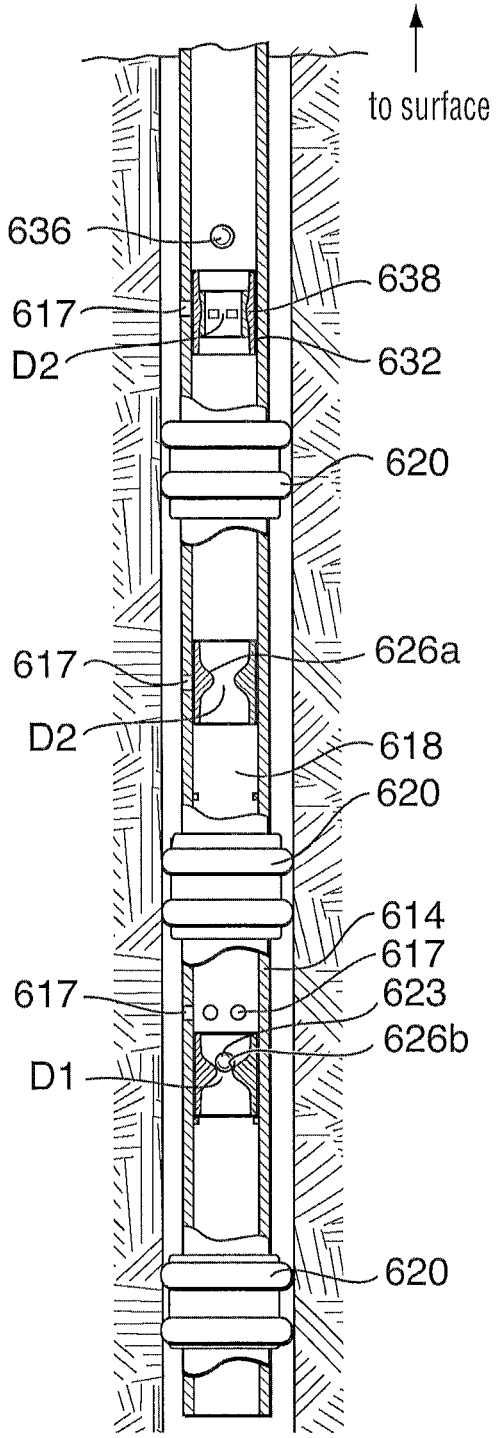
FIG. 7 is a sectional view through wellbore having positioned therein a fluid treatment assembly and showing another method according to the present invention.

In use, a wellbore tubing string apparatus, such as that shown in FIG. 7 including tools with indexing mechanisms, for example according to one of the various embodiments described herein, may be run into a wellbore and installed as desired. Thereafter the sleeves may be shifted to allow fluid treatment or production through the string. Generally, the lower most sleeves are shifted first since access to them may be complicated by the process of shifting the sleeves thereabove. In one embodiment, for example, the actuator, such as a plugging ball may be conveyed to seal against the seat of a sleeve and fluid pressure may be increased to act against the plugging ball and its seat to move the sleeve. At some point, any indexable sleeves are actuated to form their valve seats. As will be appreciated from the foregoing description, an actuator for such purpose may take various forms. In one embodiment, as shown in FIG. 7, the actuator is a device launched to also plug a lower sleeve or the actuator may act apart from the plugging ball for lower sleeves. In another embodiment, a plugging ball for a lower sleeve may actuate the formation of a valve seat on the first sleeve as it passes thereby and after which may land and seal against the valve seat of sleeve with a set valve seat. As another alternate method, a device from below a configurable sleeve can actuate the sleeve as it passes upwardly through the well. For example, in one embodiment, a plugging ball, when it is reversed by reverse flow of fluids, can move past the first sleeve and actuate the first sleeve to form a valve seat thereon.

The method can be useful for fluid treatment in a well, wherein the sleeves operate to open or close fluid ports through the tubular. The fluid treatment may be a process for borehole stimulation using stimulation fluids such as one or more of acid, gelled acid, gelled water, gelled oil, $CO_2$, nitrogen and any of these fluids containing proppants, such as for example, sand or bauxite. The method can be conducted in an open hole or in a cased hole. In a cased hole, the casing may have to be perforated prior to running the tubing string into the wellbore, in order to provide access to the formation. In an open hole, the packers may be of the type known as solid body packers including a solid, extrudable packing element and, in some embodiments, solid body packers include a plurality of extrudable packing elements. The methods may therefore, include setting packers about the tubular string and introducing fluids through the tubular string.

FIGS. 8A to 8F show a method and system to allow several sliding sleeve valves to be run in a well, and to be selectively activated. The system and method employs a tool as described herein that will shift through several "inactive" shifting cycles (FIGS. 1 to 3). Once each valve passes through all its passive cycles, it can move to an "active" state (FIGS. 4). Once it shifts to the active state, the valve can be shifted from closed to open position (FIG. 5), and thereby allow fluid placement through the open parts from the tubing to the annulus.

Figure 8A:
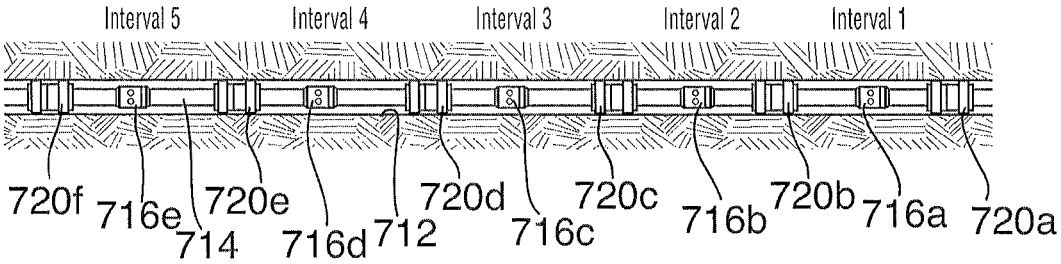
FIGS. 8A to 8F are a series of schematic sectional views through a wellbore having positioned therein a fluid treatment assembly showing a method according to the present invention.

FIG. 8A shows a tubing string 714 in a wellbore 712. A plurality of packers 720 *a-f* can be expanded about the tubing string to segment the wellbore into a plurality of zones where the wellbore wall is the exposed formation along the length between packers. The string may be considered to have a plurality of intervals 1-5, each interval identified as between each adjacent pair of packers. Each interval includes at least one port and a sliding sleeve valve thereover (within the string), which together are designated 716 *a-e*. Sliding sleeve valve 716*a* includes a ball stop, herein called a seat, that permits a ball-actuated axial force to be applied to move the sleeve away from the ports it covers. Sliding sleeve valves 716*b* to 716*e* each include therein collapsible seats which are formable to non-collapsible seats when actuated to do so by use of an indexing mechanism for ratcheted movement of the seat between inactive positions where the seat is collapsible and an active position where the seats is activated and formed in a non-collapsible manner. For example, the seats of sleeves 716*a* to 716*e* may be similar to seat 16 as shown in FIGS. 1 to 5, that is configurable to a ball retaining diameter upon being ratcheted into an active position.

Initially, as shown in FIG. 8A, all ports are in the closed position, wherein they are closed by their respective sliding sleeve valves.

Figure 8B:
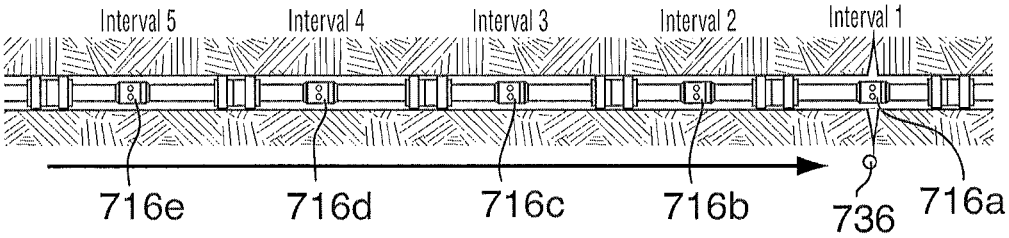

As shown in FIG. 8B a ball 736 may be pumped onto a seat in the sleeve 716*a* to open its port in Interval 1. A wellbore fluid treatment may be effected through the ports opened by sleeve 716*a*. When the ball passes through the sleeves 716*c-e* in Intervals 5, 4, and 3, they make a passive shift from one inactive notch position to a next inactive notch position. When the ball passes through Interval 2, it moves the indexing mechanism into a final notch and a non-collapsible ball stop is formed on sleeve 716*b* on that interval such that it can be shifted to the open position when desired.

Figure 8C:
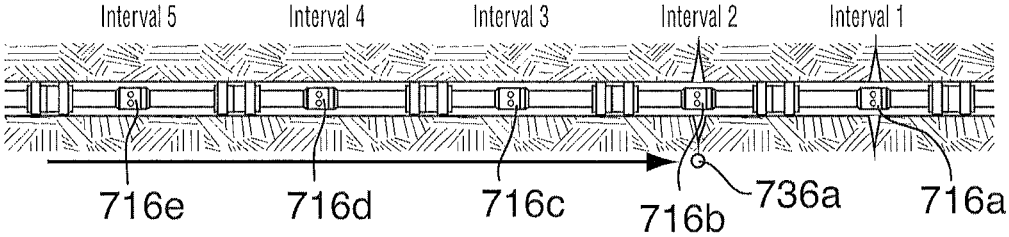

Next, as shown in FIG. 8C, a ball 736*a* is pumped onto the activated seat in sleeve 716*b* to open the port in Interval 2. When it passes through the sleeves in Intervals 5, and 4, they make a passive shift. When the ball passes through Interval 3, it moves sleeve 716*c* from an inactive position to an active position so that it can be shifted to the open position when desired. When ball 736*a* lands in sleeve 716*b* in Interval 2, it opens that sleeve by landing on the ball stop formed in FIG. 8B and a wellbore fluid treatment may be effected through the ports opened by sleeve 716*b*.

Figure 8D:
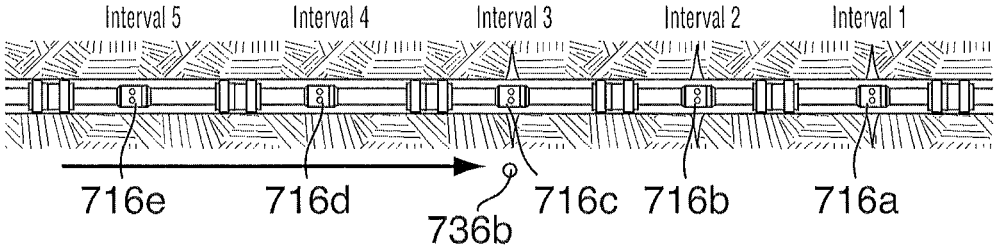

Thereafter, as shown in FIG. 8D, a ball 736*b* is pumped onto the activated seat in sleeve 716*c* to open the port in Interval 3. When ball 736*b* lands in sleeve 716*c*, it opens that sleeve by landing on the ball stop formed in FIG. 8C and a wellbore fluid treatment may be effected through the ports opened by sleeve 716*c*. When ball 736*b* passes through the sleeve 716*e* in Interval 5, that sleeve makes a passive shift moving from one inactive notch position to a next inactive notch position. When the ball passes through Interval 4, it moves sleeve 716*d* from inactive to active, for example, into a final notch, so that sleeve 716*d* can be shifted to the open position when desired.

Figure 8E:
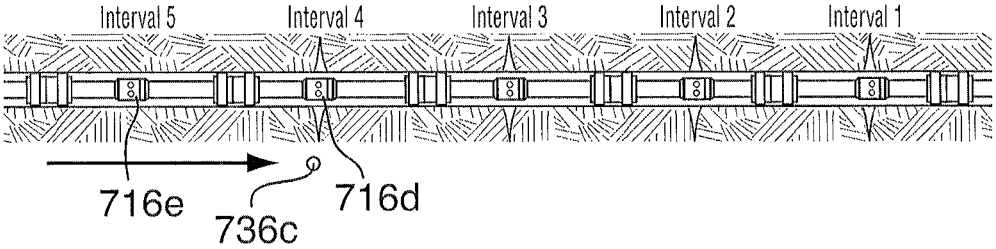

Thereafter, as shown in FIG. 8E, a ball 736*c* is pumped onto the activated seat of sleeve 716*d* to open the port in Interval 4 and a fluid treatment may be effect therethrough.

When ball 736*c* passes through Interval 5, it moves sleeve 716*e* from inactive to active so that it can be shifted to the open position when desired.

Figure 8F:
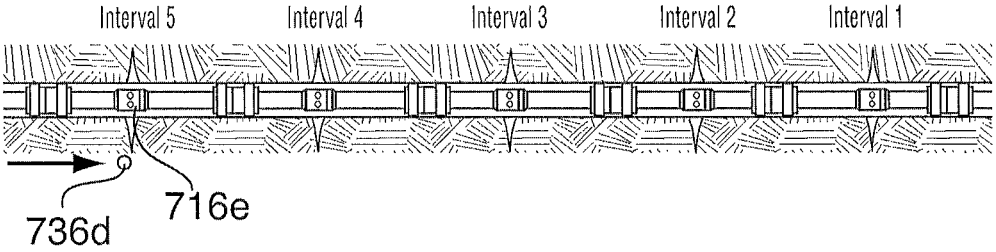

Thereafter, as shown in FIG. 8F, a ball 736*d* is pumped onto the activated seat of sleeve 716*e* to open the port in Interval 5 completing opening of all ports.

With reference to the tool of FIGS. 1 to 5, it is noted that sleeve 716*b* of Interval 2 would be installed with the dog in the first notch away from the deeper notch, such that after one actuation thereof (i.e. after one ball passes therethrough), the dog would land in the deeper notch and the seat would be activated in a non-collapsible form. Likewise, the sleeve 716*c* of Interval 3 would be installed with its dog in the second notch away from the deeper notch, such that after two actuations thereof (i.e. after two balls pass therethrough), the dog would land in the deeper notch and the seat would be activated in a non-collapsible form. The other sleeves, 716*d* and 716*e* would have their dogs in the third and fourth inactive notches, respectively.

When the ports are each opened, the formation accessed therethrough can be stimulated as by fracturing. It is noted, therefore, that the formation can be treated in a focused, staged manner. It is also noted that balls 736-736*d* may all be the same size, but still this portion of the formation can be treated in a focused, staged manner, through one port at a time. Note that while only five ports are shown in this segment of the string, more than five ports can be run in a string. The intervals need not be directly adjacent, as shown, but can be spaced and there can be more than one port/sleeve per interval (i.e. at least two ports in one interval that open after the same number of actuations or which open in sequence). Further similar series of ports could be employed above and/or below this series, which use other sized balls. Of course, any sleeves below that use a different sized ball will use a smaller ball that can pass through the illustrated sleeves without actuating them.

This system and tool of FIG. 8 provides a substantially unrestricted internal diameter along the string and allows a single sized ball or other plug to function numerous valves.

The sleeves may sense the passing of a ball by various mechanisms, for example those as shown including deformable seats, deformable balls that squeeze through a fixed seat, or other mechanisms such a collets, c-rings, etc. As shown by sleeve 716*a,* the system can use combinations of solid ball seats and sleeves with indexing mechanisms. The system allows for installations of fluid placement liners of very long length forming large numbers of separately accessible wellbore zones.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A wellbore tool comprising: a tubular housing including an upper end, a lower end, and a wall defining an inner bore and an outer surface; a tool mechanism capable of being moved through a plurality of positions; an indexing mechanism for moving the tool mechanism through the plurality of positions, the indexing mechanism including an axis, a first ratchet sleeve including a first plurality of teeth extending substantially parallel to the axis and a notch between each adjacent pair of teeth of the first plurality of teeth, a dog sleeve including an end and a dog extending axially from the end, the dog configured for meshing with the first plurality of teeth of the ratchet sleeve, the dog sleeve and/or the ratchet sleeve being axially and rotationally moveable to permit the dog and the first plurality of teeth to move into and out of engagement and to permit the dog to move from notch to notch along the first ratchet sleeve, the movement from notch to notch corresponding to movement of the tool mechanism through the plurality of positions; a biasing member for urging the dog and the first plurality of teeth into meshing engagement, the biasing member able to be overcome to allow movement of the dog and the first plurality of teeth axially out of meshing engagement; and an actuating mechanism for generating an application of force against the biasing member to move the dog axially out of meshing engagement to move from notch to notch.

2. The wellbore tool of claim 1 wherein the tool mechanism is a sliding sleeve valve moveable to open and close a port through the wall of the tubular housing and the plurality of positions includes a port closed position and a port open position of the sliding sleeve valve relative to the port.

3. The wellbore tool of claim 1 wherein the tool mechanism is a plug seat in the inner diameter and the plurality of positions includes a final position in which the plug seat has a non-collapsible form.

4. The wellbore tool of claim 1 wherein the tool mechanism is a plug seat in the inner diameter and the plurality of positions includes a collapsible position and a non-collapsible position.

5. The wellbore tool of claim 1 wherein the actuating mechanism rotationally drives the dog sleeve and/or the ratchet sleeve.

6. The wellbore tool of claim 1 wherein the actuating mechanism includes an axially moveable actuating sleeve and a ball seat on the actuating sleeve.

7. The wellbore tool of claim 6 wherein the actuating sleeve includes a second plurality of ratchet teeth on an end thereof for converting the axial movement to a rotational drive for the dog sleeve and/or the ratchet sleeve.

8. The wellbore tool of claim 7 wherein the actuating sleeve is positioned concentrically within the first ratchet sleeve and the second plurality of ratchet teeth contact the dog.

9. The wellbore tool of claim 1 wherein the actuating mechanism includes an axially moveable actuating sleeve and a ball seat on the actuating sleeve and the actuating sleeve includes a second plurality of ratchet teeth on an end thereof for converting the axial movement to a rotational drive for the dog sleeve and/or the ratchet sleeve.

10. The wellbore tool of claim 9 wherein the actuating sleeve is positioned concentrically within the first ratchet sleeve and the second plurality of ratchet teeth contact the dog.

11. The wellbore tool of claim 1 wherein the dog sleeve is axially and rotationally moveable.

12. A method for actuating a downhole tool as defined in claim 1 to an active condition, the method comprising: axially moving a component of an indexing mechanism to move a dog in the downhole tool into and out of meshing engagement with a crown ratchet sleeve, the dog being moved from a first notch to a next notch in the indexing mechanism until the dog reaches a final notch in the indexing mechanism, the tool being configured into an active condition when the dog reaches the final notch.

13. The method of claim 12 wherein axially moving includes axially moving a sleeve in the tool by introducing an actuator into an inner diameter of the tool.

14. The method of claim 12 wherein axially moving a sleeve includes passing an actuator through the inner diameter of the tool.

15. The method of claim 14 wherein the actuator is a plug and passing through the inner diameter includes landing in a seat.

16. The method of claim 12 further comprising biasing the component into a first axial position and axially moving overcomes the biasing to move the dog from notch to notch.

17. The method of claim 12 wherein axially moving includes lifting the dog from the first notch and applying a rotational force to position the dog into the next notch.

18. The method of claim 12 wherein in the active condition, a sleeve in the downhole tool is moved to open fluid ports from the downhole tool to access an annulus between the downhole tool and a wellbore.

19. The method of claim 12 wherein in the active condition, a seat is formed in a sleeve in the downhole tool upon which a plug can be landed to move the sleeve to open fluid ports from the downhole tool to access an annulus between the downhole tool and a wellbore.

* * * * *